US009343223B2

(12) United States Patent
Suzuki et al.

(10) Patent No.: US 9,343,223 B2
(45) Date of Patent: May 17, 2016

(54) REACTOR

(71) Applicant: TAMURA CORPORATION, Tokyo (JP)

(72) Inventors: Kotaro Suzuki, Saitama (JP); Ryo Nakatsu, Saitama (JP); Naoki Inoue, Saitama (JP); Kensuke Maeno, Saitama (JP)

(73) Assignee: TAMURA CORPORATION, Tokyo (JP)

( * ) Notice: Subject to any disclaimer, the term of this patent is extended or adjusted under 35 U.S.C. 154(b) by 217 days.

(21) Appl. No.: 14/219,863

(22) Filed: Mar. 19, 2014

(65) Prior Publication Data

US 2014/0292456 A1 Oct. 2, 2014

(30) Foreign Application Priority Data

Mar. 29, 2013 (JP) ..... 2013-074694
Nov. 22, 2013 (JP) ..... 2013-242355

(51) Int. Cl.

| | |
|---|---|
| ***H01F 27/08*** | (2006.01) |
| ***H01F 27/02*** | (2006.01) |
| ***H01F 27/29*** | (2006.01) |
| ***H01F 27/30*** | (2006.01) |
| ***H01F 27/24*** | (2006.01) |
| ***H01F 27/40*** | (2006.01) |
| ***H01F 27/26*** | (2006.01) |
| ***H01F 27/32*** | (2006.01) |
| ***H01F 27/00*** | (2006.01) |

(52) U.S. Cl.

CPC ..... *H01F 27/402* (2013.01); *H01F 27/00* (2013.01); *H01F 27/263* (2013.01); *H01F 27/29* (2013.01); *H01F 27/306* (2013.01); *H01F 27/325* (2013.01); *H01F 2027/406* (2013.01)

(58) Field of Classification Search

CPC ..... H01F 2027/263; H01F 27/008; H01F 27/306; H01F 27/402; H01F 37/00; H01F 27/325; H01F 27/29
USPC ..... 336/55, 83, 192, 198, 212
See application file for complete search history.

(56) References Cited

U.S. PATENT DOCUMENTS 5,576,676 A * 11/1996 Koller ..... H01H 50/047 335/132
8,033,723 B2 10/2011 Maeno et al.

(Continued)

FOREIGN PATENT DOCUMENTS

JP 2010-203998 9/2010
JP 2012-243913 12/2012

*Primary Examiner* — Mangtin Lian
*Assistant Examiner* — Kazi Hossain

(57) ABSTRACT

A reactor includes an annular core, coils, a sensor detecting a state of the reactor, and a connector outputting signal from the sensor. Resin-molded bodies are provided around the annular core. The resin-molded body has bobbins for the respective coils and core covering portions formed integrally with each other. An exposed area where no resin covers the bottom of the core is formed in the lower face of the covering portions. A holder to fasten the connector is formed integrally with the upper portion of the covering portion. An assembly including the resin-molded bodies in which the annular core is embedded, and the coils wound around the bobbins are retained in a metal casing. A clearance is formed between the assembly and the casing, and a filler is filled in this clearance. The filler covers the exposed area of the core bottom.

18 Claims, 8 Drawing Sheets

(56) References Cited

U.S. PATENT DOCUMENTS

2002/0014941 A1* 2/2002 Yoshioka ..... H01F 37/00 336/184
2009/0027151 A1* 1/2009 Nakatsu ..... H01F 3/14 336/212
2009/0108971 A1* 4/2009 Okamoto ..... H01F 37/00 336/65
2009/0144967 A1* 6/2009 Hasu ..... H01F 27/2847 29/605
2010/0226410 A1* 9/2010 Maeno ..... H01F 27/402 374/208
2012/0126928 A1* 5/2012 Yoshikawa ..... H01F 27/306 336/221
2012/0139684 A1* 6/2012 Kobayashi ..... H01F 27/022 336/92
2012/0194311 A1* 8/2012 Suzuki ..... H01F 27/266 336/92
2013/0038415 A1* 2/2013 Ooishi ..... H01F 37/00 336/61
2013/0106556 A1* 5/2013 Suzuki ..... B29C 70/68 336/212

* cited by examiner

REACTOR

CROSS-REFERENCE TO RELATED APPLICATIONS

This application is based upon and claims the benefit of priority from Japanese Patent Application NO. 2013-074694, filed on Mar. 29, 2013 and Japanese Patent Application NO. 2013-242355, filed on Nov. 22, 2013; the entire contents all of which are incorporated herein by reference.

FIELD OF THE INVENTION

The present disclosure relates to a reactor having an improved disposition of a sensor connector.

BACKGROUND ART

Many reactors applied to an in-vehicle booster circuit employ a structure in which a coil is wound around a resin-made bobbin disposed around a core, those are retained in a metal casing, and a filler is filled in the casing and is let cured.

Among those reactors, there is known a type which combines multiple divisional core pieces to form an annular core, and has coils wound around the right and left core legs. Each divisional core piece is embedded in a resin, and the resin portion serves as the covering portion of the core and the bobbin for the coils. In order to dispose a resin around the core, in general, molding is applied.

In addition, according to this type of reactor, a bus bar is connected to an end of the coil, and a wiring for a connection with an external device of the reactor is attached to a screw hole by screwing provided in the tip of the bus bar. That is, it is difficult to directly connect a wiring like a covered electric wire to an end of the coil formed by letting a wire like a rectangular wire to be wound around such a coil. Accordingly, the bus bar is connected to the end of the coil by welding, etc., a screw hole is provided in the tip of the bus bar, and a wiring and the bus bar are connected, or a connector provided at the wiring side is press-fitted to or engaged with the end of the bus bar.

Conventionally, the bus bar connected to the coil end is embedded in, together with a clamp (referred to as a stay) to fastening the core and the reactor to the casing, the interior of the resin-molded body integrally molded with the bobbin where the coil is wound by molding. In order to form a reactor, a coil wound in a cylindrical shape is attached to the outer circumference of the bobbin of this resin-molded body, and with the end of the coil and the bus bar embedded in the resin-molded body being in contact with each other, both are welded.

According to this type of reactor, when a high current continuously flows, the coil is heated, and the electric characteristic decreases. Hence, the internal temperature is measured through a temperature sensor like a thermistor, and an electrical conduction is controlled so as not to cause the coil to be heated to equal to or greater than a predetermined temperature.

When the reactor is provided with a sensor, in order to detect a temperature precisely, it is necessary to dispose the sensor near the coil and the core which generate heats. Accordingly, as disclosed in JP 2010-203998 A and JP 2012-243913 A, a structure in which the sensor is disposed between the right and left coils is employed. According to such conventional technologies, since the sensor is disposed at the center of the reactor, there is an advantageous effect that the detection precision of the temperature is excellent.

Meanwhile, according to a reactor including this type of sensor, a connector is necessary which connects the lead wire from the sensor with the wiring inside a vehicle. This connector needs a dimension to some level so as to ensure the insulation at the connected portion and to facilitate a manual connection work. While at the same time, it is necessary to fasten the connector using some holder so as not to move due to vibration, etc.

According to the reactor having the above-explained core embedded in the resin by molding, as a connector holder of this type, it is simple if a protrusion or a recess which catches the connector is provided in the resin portion. When, however, molding is performed, depending on the shape of a mold to be utilized, and the position and shape of the core to be disposed inside the resin portion, the position and shape of the holder are restricted.

In addition, the shape of the mold becomes complex when merely molding the cylindrical bobbin with the resin-molded body in an integral manner. Still further, the structure of the resin-molded body becomes complex when the core, the stay, and further the bus bar are embedded in the resin-molded body, making the manufacturing difficult. Yet further, when the reactor is connected with an external device, it is necessary to draw wirings in various directions depending on the position, shape, and size of the external device to be connected. When, however, the bus bar is embedded in the resin-molded body, the position of the bus bar is limited to the location where the bus bar is embedded in the resin-molded body only. Therefore, it is difficult to draw the bus bar in optional directions, such as the front, rear, right and left of the reactor.

In particular, since the bus bar supplies power to the coil, it is necessary to ensure a sufficient insulation against the core and the stay, etc., but when the bus bar, the core, and the stay are present in the same resin-molded body, for the purpose of the insulation among those pieces, it is necessary to make the resin-molded body thickened, resulting in an increase in the size of the resin-molded body, and an increase in the apply amount of the resin.

In addition, according to this type of reactor, when a high current continuously flows, the coil is heated and the electric characteristic decreases. Moreover, it becomes beyond the withstand temperature of the material, and the reliability is deteriorated. Accordingly, the internal temperature is measured through a temperature sensor like a thermistor to perform an electrical conduction control so as not to cause the coil to be heated to equal to or greater than a certain temperature. When the reactor is provided with a temperature sensor, it is necessary to dispose the sensor near the coil and the core which generate heat to precisely detect a temperature. Conversely, it is necessary to provide a sensor connector for the reactor to transmit detections signals from the sensor to the external device.

According to conventional technologies, since it is difficult to obtain a sufficient space, it is difficult to provide a connector itself at all, the connector is fastened to the exterior of the reactor, or a hook is provided at a largely projected portion of the resin-molded body from the casing to fasten the connector. However, since the core, the stay, and the bus bar, etc., are embedded in the resin-molded body, it is necessary to provide a holder so as not to interfere therewith, and thus the disposition of the connector is restricted.

The reasons of those problems will be explained with reference to a conventional reactor illustrated in FIGS. 13 and 14. According to this type of reactor, bobbins 102 are provided at respective outer circumferences of the right and left core legs of an annular core 101, and coils 103 are wound therearound. The yoke portion of the core 101 where no coil 103 is wound is covered over by a covering portion 104 integrally molded with bobbins 102. A support plate 105 to hold a sensor is integrally provided with the bobbins 102 between the right and left bobbins 102. A catch 106 to hook up lead wires of the sensor is provided at the portion of the covering portion 104 near the bobbins 102.

According to this type of reactor, in order to dispose the bobbins 102 around the core 101, in general, the core 101 is placed in a mold, and molding is applied which fills a resin to the interior of the mold around the core 101 and lets the resin cured. In this case, when there is a space between the mold surface and the core 101, the resin enters such a space, becoming burrs after the molding. In particular, according to the conventional technologies, the core 101 is caused to be in contact with the bottom of an aluminum-made casing 108 that retains thereinside a reactor to directly dissipate heat from the core 101. Hence, when burrs are present, a gap is formed between the casing 108 and the core 101. Accordingly, the heat dissipation performance deteriorates. Therefore, according to the conventional technologies, the core 101 is pushed by a spring from the upper space thereof to eliminate a space between the mold surface and the core 101, thereby suppressing a formation of burrs.

As explained above, to push the core 101 from the upper space thereof, it is necessary to let the spring to be in contact with the core 101. Accordingly, it is difficult to fill the resin on the upper face of the core 101. According to the conventional technologies, an opening 107 where no resin is present is formed on the upper face of the covering portion 104 covering the core 101 to position the core 101 in the mold. When, however, the opening 107 is present on the upper face of the core 101, it is difficult to provide the holder of a connector, the stay, and the bus bar, etc., in this location, and thus the holder is provided at a part of the casing 108 that retains thereinside the reactor, the holder is formed using a resin so as to project from the side of the core 101, and making a part of the resin-molded body be projected to a side, and, each component is disposed at the projected part.

The holder provided at a side of the core 101 increases the dimension of the reactor in the horizontal direction, disturbing a downsizing. In addition, the conventional technologies that push the core against the mold surface when a resin is filled needs to additionally provide a pushing mechanism together with the mold, and makes the structure of the mold complex. Hence, it is not suitable.

Likewise, when a part of the resin-molded body is projected to a side, the dimension of the reactor in the horizontal direction increases by what corresponds to the projection, which disturbs a downsizing of the reactor. In addition, the position where the bus bar and the holder of the connector can be disposed is restricted. In particular, among the conventionally well-known reactors, there is a type that draws a drawn part 103*a* of the coil end from the yoke-side of the core. According to this type of reactor, when ends of the coil 103 are drawn from the two yoke sides, respectively, opposite to each other, the drawn part 103*a* interferes with the disposition of the bus bar and the connector on the upper face of the covering portion 104.

The present disclosure has been made to address the aforementioned technical problems of the conventional technologies. The present disclosure integrally forms a holder by a resin on the upper portion of a core to enable a downsizing of a reactor, and eliminates the necessity of a work of pushing the core against a mold surface, thereby simplifying a resin molding work and the structure of the mold.

In addition, the present disclosure reduces the number of components embedded in a resin-molded body including a core to simplify the resin-molded body and the structure of the mold thereof, to simplify a manufacturing process associated therewith, and to downsize a whole reactor.

Still further, the present disclosure ensures a leeway for the degree of freedom for a disposition of a terminal stage, and an excellent insulation performance, and enables a disposition of the holder of a connector of an electronic component like a temperature sensor in an arbitrary location on the reactor.

SUMMARY OF THE INVENTION

According to an aspect of the present disclosure, a reactor includes: an annular core; a coil wound around an outer circumference of the annular core; a resin-molded body comprising a covering portion of the annular core and a bobbin around which the coil is wound, the covering portion and the bobbin being formed integrally; a core exposed area provided in a lower face of the covering portion; a holder formed at an upper portion of the covering portion in a manner integral with the covering portion; a connector held by the holder; and a sensor which is connected to the connector, detects a state of the reactor, and outputs a signal through the connector.

According to another aspect of the present disclosure, a reactor includes: an annular core; a coil wound around an outer circumference of the annular core; a lead portion provided at an end of the coil; a bus bar connected to the lead portion; a resin-molded body in which the annular core is embedded; a terminal stage which is provided separately from the resin-molded body, and which has the bus bar embedded therein by molding; a holder integrally formed with the terminal stage; a connector held by the holder; and a sensor connected to the connector.

The plurality of terminal stages each having the bus bar connected to the lead portion of the coil end by molding may be provided, and at least one of the plurality of terminal stages may be formed integrally with a holder for a connector for picking up a wiring of an electronic component provided in the reactor.

It is desirable that no opening should be present in the upper face of the resin-molded body, and it is further desirable if the terminal stage is provided in such a portion. An exposed area which does not cover the bottom of the core may be provided in the lower face of the resin-molded body, and the core may be supported by a mold through this exposed area at the time of core molding.

As the aforementioned holder, in accordance with the shape of the connector to be connected therewith, various structures, such as a sliding type, a fitting type, and a hook shape, can be employed. The connector holder may be provided at each of the plurality of the terminal stages, or may be provided at one terminal stage.

According to the present disclosure, it becomes unnecessary to push the core against a mold at the time of molding, and thus the holder can be integrally formed on an upper portion of the core by a resin. As a result, since the holder and a connector connected therewith are disposed on the upper portion of the core, the reactor can be downsized. In addition, a mechanism for pushing the core against the mold becomes unnecessary, and the number of manufacturing processes of the reactor can be reduced.

Still further, the bus bar is molded on a terminal stage that is a separate component from the resin-molded body in which the core is embedded, and thus the disposition of the terminal stage can be designed freely. Hence, a connection wiring to the coil can be disposed in any direction of the reactor. Moreover, the number of components to be molded in the resin-molded body in which the core is embedded can be reduced, and thus the resin-molded body and the structure of a mold can be simplified, thereby reducing the number of manufacturing processes of the reactor.

DETAILED DESCRIPTION OF THE EMBODIMENTS

Figure 1:
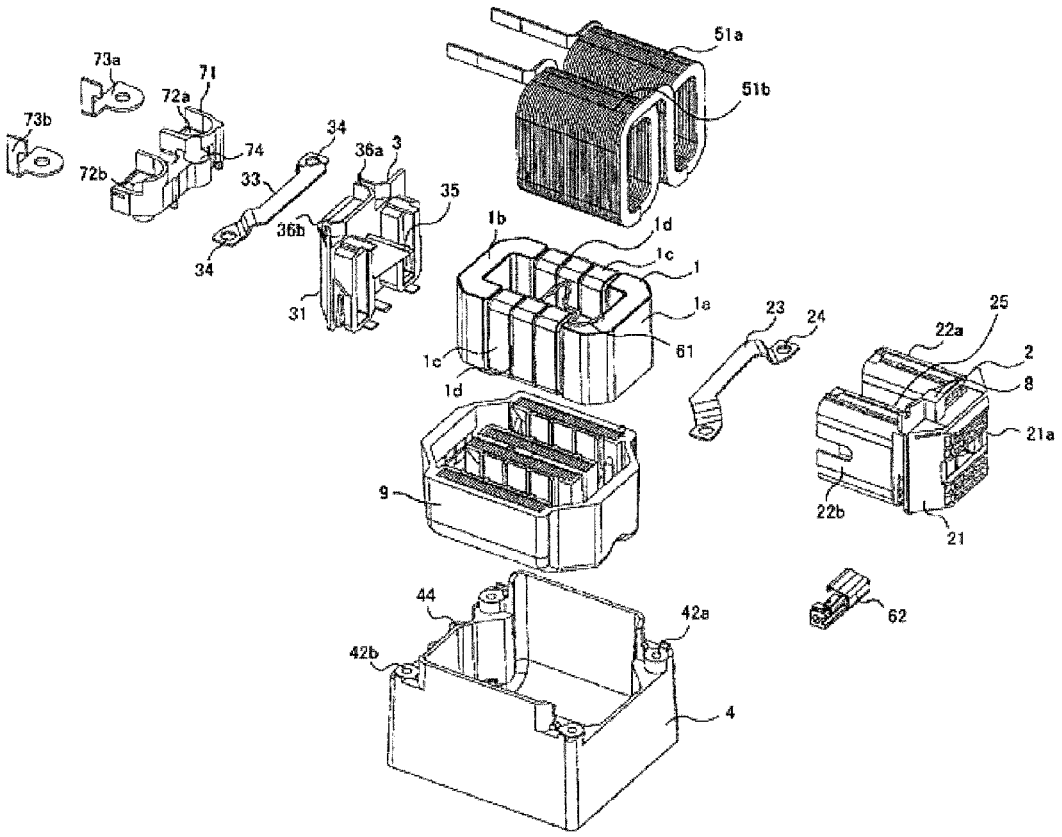
FIG. 1 is an exploded perspective view illustrating a reactor according to a first embodiment.

A first embodiment of the present disclosure and a second embodiment thereof will be explained in detail with reference to FIGS. 1 to 6, and FIGS. 7 to 12, respectively.

1. First Embodiment

Structure

A reactor of this embodiment includes an annular core 1 which includes two U-shaped cores 1*a*, 1*b* forming a yoke of the reactor, and three I-shaped cores 1*c* forming each of right or left core leg. Those u-shaped cores 1*a*, 1*b* and the I-shaped cores 1*c* are connected via spacers 1*d*.

The annular core 1 is covered by two resin-molded bodies 2, 3 provided on the outer circumference of the annular core 1 at the bobbin side and at the terminal side. The resin-molded body 2 at the bobbin side includes right and left cylindrical bobbins 22*a*, 22*b*, and a core covering portion 21 provided so as to interconnect those. The first U-shaped core 1*a* is embedded in the interior of the covering portion 21 by molding. The three I-shaped cores 1*c* are inserted in the right or left bobbin 22*a*, 22*b* from the opening at the end of the bobbin. The resin-molded body 3 at the terminal side includes a core covering portion 31, and the second U-shaped core 1*b* is embedded in the interior of the core covering portion 31 by molding.

Openings 21*a*, 31*a* utilized to hold the U-shaped cores 1*a*, 1*b* in a metal mold at the time of molding are provided in the external faces of the covering portions 21, 31, and the surfaces of the internal U-shaped cores 1*a*, 1*b* are exposed in the openings 21*a*, 31*a*. No resin is present on the bottoms of the covering portions 21, 31 to set the U-shaped cores 1*a*, 1*b* on the surface of the mold, and such an area forms an exposed area 1*e* where the bottoms of the U-shaped cores 1*a*, 1*b* are exposed. According to this embodiment, however, it should be noted that burrs of a resin may be present in this area, since the U-shaped cores 1*a*, 1*b* are not to be pushed from the upper portion thereof toward the surface the metal mold.

Brackets 23, 33 are embedded in the covering portions 21, 31 at the bobbin side and at the terminal side to fix the annular core 1 to a casing 4. The both ends of the brackets 23, 33 protrude from the surfaces of the covering portions 21, 31, and such portions is provided with screw insertion holes 24, 34 to fix the annular core 1 to the casing 4. When screws 41*a*, 41*b* fitted in those screw insertion holes 24, 34 are fastened with screw holes 42*a*, 42*b* of the casing 4, the annular core 1 is fixed to the casing 4.

Support plates 25, 35 to hold a sensor are provided, at locations held between the right and left bobbins 22*a*, 22*b*, inside the covering portions 21, 31 at the bobbin side and at the terminal side. The support plates 25, 35 are each a triangular member that allows a fitting of a sensor 6 between both plates at the time of an assembling of the annular core 1. A lead wire 61 of the sensor 6 is drawn to the cover—21 side at the bobbin side, and a connector 62 is connected to the tip of such a wire.

Right and left coils 51*a*, 51*b* are wound around respective outer circumferences of the right and left bobbins 22*a*, 22*b*. Those right and left coils 51*a*, 51*b* are each formed by, for example, a conductor wire, and both ends thereof are drawn at the terminal side towards the direction of the cover portion 31. The right and left coils 51*a*, 51*b* may be formed by different conductors. Grooves 36*a*, 36*b* where ends of the coils 51*a*, 51*b* are fitted are formed integrally with the covering portion 31 at the terminal side.

At the outside of the covering portion 31 of the terminal side, a resin-made terminal stage 71 is provided separately from the covering portion 31. The terminal stage 71 is provided with two recesses 72*a*, 72*b*, and metal terminals 73*a*, 73*b* are fastened to the respective inside those recesses. Portions of the terminals 73*a*, 73*b* are lifted upwardly, and the ends of the coils 51*a*, 51*b* are connected to the lifted portions. The terminal stage 71 is provided with a screw insertion hole 74, and when a screw 43 fitted in this screw insertion hole 74 is fastened with a screw hole 44 of the casing 4, the terminal stage 71 is fixed to the casing 4.

A holder 8 for the connector 62 is formed integrally with the covering portion 21 on the upper portion thereof at the bobbin side. The holder 8 can be any shape as long as the connector 62 can be fixed to the covering portion 21, but according to this embodiment, the following shape is employed in accordance with the shape of the connector 62.

Figure 2:
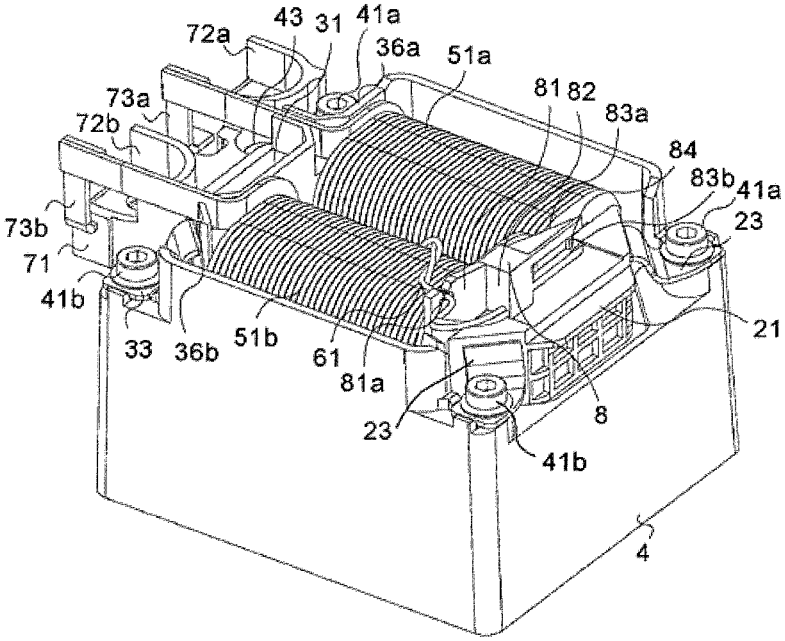
FIG. 2 is a perspective view of the reactor in FIG. 1 as viewed from the front right.
Figure 3:
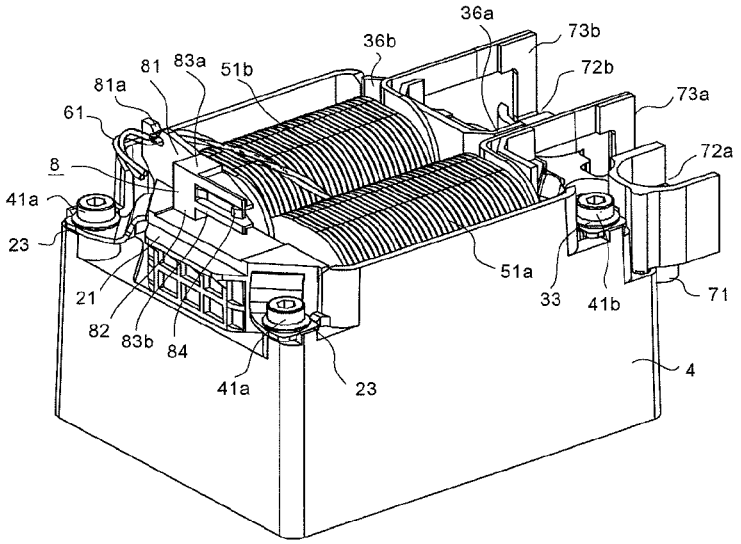
FIG. 3 is a perspective view of the reactor in FIG. 1 as viewed from the rear right.
Figure 4:
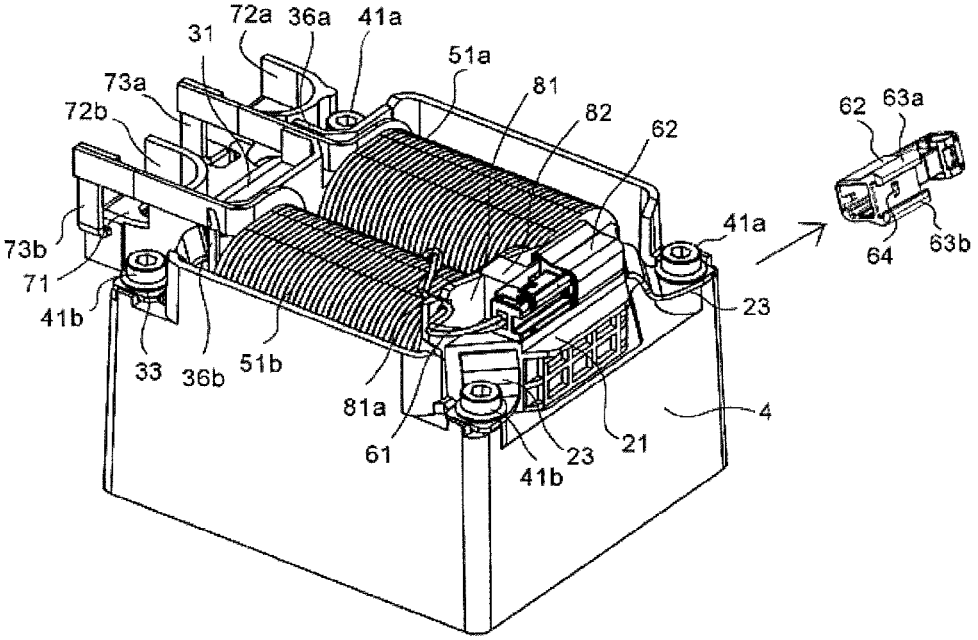
FIG. 4 is a perspective view of the reactor in FIG. 1 attached with a connector and as viewed from the front right.
Figure 5:
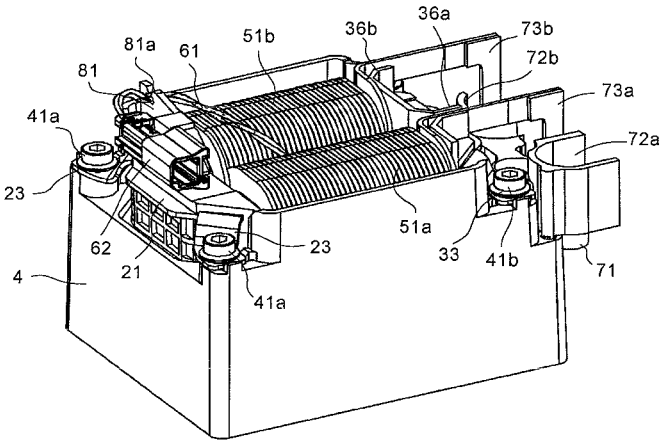
FIG. 5 is a perspective view of the reactor in FIG. 1 attached with the connector and as viewed from the rear right.

As illustrated in FIGS. 2 and 3, a vertically uprising wall 81 is provided at a portion of the upper face of the covering portion 21 at the bobbin side, and a catch 81*a* to hook up the lead wire of the sensor is provided in the upper edge of the wall 81. A block 82 is formed integrally with the wall 81 near the catch portion 81*a*, and upper and lower two guides 83*a*, 83*b* running orthogonal to the axial direction of the bobbin are provided in the block 82 in parallel with each other while maintaining a certain clearance. The upper and lower two guides 83*a*, 83*b* are each a member with an L-shaped cross section, and the vertical portion thereof is slidably inserted in each of two slots 63*a*, 63*b* provided in the connector 62. A hook 84 is provided between the upper and lower guides 83*a*, 83*b*, and the hook 84 has a basal portion fixed to the block 82 as well as a free end. The end of the hook 84 is engaged with a protrusion 64 provided between the two slots 63*a*, 63*b* of the connector 62.

The annular core 1, the resin-molded bodies 2, 3, and the right and left coils 51*a*, 51*b* employing the above explained structures are retained in the casing 4 in an assembled condition, and are fastened to the casing 4 by fastening the brackets 23, 33 with screws. In this case, the resin-molded bodies 2, 3 and the right and left coils 51*a*, 51*b* are fastened so as to maintain a predetermined clearance between the outer circumferences thereof and the inner face of the casing 4. When a filler 9 is filled in that clearance and is cured, the casing 4 and the assembled annular core 1 are integrated with each other.

Advantageous Effects

Figure 6:
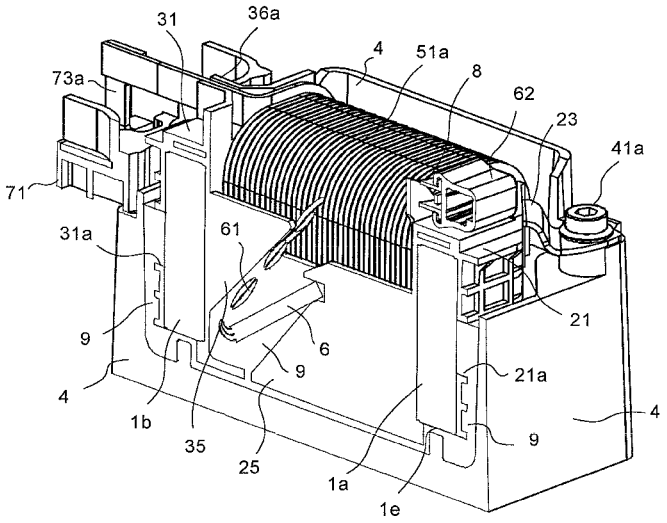
FIG. 6 is a cross-sectional view of the reactor in FIG. 1.
Figure 7:
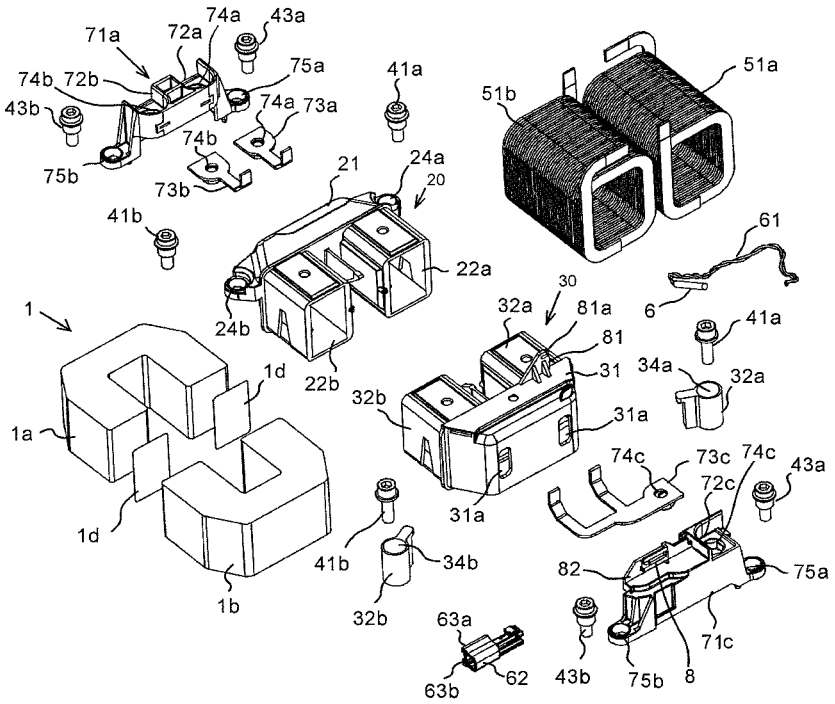
FIG. 7 is an exploded perspective view illustrating a reactor according to a second embodiment.

According to the first embodiment employing the above-explained structure, as illustrated in the cross-sectional view of FIG. 6, the bottoms (exposed area 1*e*) of the U-shaped cores 1*a*, 1*b* exposed at the bottoms of the covering portions 21, 31 are covered by the filled filler 9. As a result, even if there is a resin that forms bottom burrs of the U-shaped cores 1*a*, 1*b* at the time of molding, such portions are covered by the filler 9, which does not cause a technical problem. Conversely, it is unnecessary to provide an opening in the upper portion of the covering portion 21, and thus the holder 8 can be provided at this portion to fasten the connector 62. As a result, it becomes possible to retain the connector 62 within a planar projection area of the resin-molded body 2, thus downsizing the reactor.

2. Second Embodiment

Structure

A reactor according to this embodiment includes the annular core 1 that has two U-shaped cores 1*a*, 1*b* which forms a yoke of the reactor and which are connected together via spacers 1*d*.

The annular core 1 is covered by a first resin-molded body 20 and a second resin-molded body 30 provided around the outer circumference of the annular core 1. The first resin-molded body 20 includes cylindrical right and left bobbins 22*a*, 22*b*, and a core covering portion 21 provided so as to interconnect those. A first U-shaped core 1*a* is embedded in the first resin-molded body 20 by molding. The second resin-molded body 30 includes right and left holders 32*a*, 32*b*, and a core covering portion 31, and a second U-shaped core 1*b* is embedded in the second resin-molded body 30 by molding.

Openings 21*a*, 31*a* utilized to hold the U-shaped cores 1*a*, 1*b* in a metal mold at the time of molding are provided in outer surfaces of the covering portions 21, 31, and surfaces of the U-shaped cores 1*a*, 1*b* are exposed in the openings 21*a*, 31*a*. No resin is present on the bottoms of the covering portions 21, 31 to set the U-shaped cores 1*a*, 1*b* to the surface of the mold, and such an area forms an exposed area 1*e* where the bottoms of the U-shaped cores 1*a*, 1*b* are exposed. According to this embodiment, however, it should be noted that burrs of a resin may be present in this area, since the U-shaped cores 1*a*, 1*b* are not to be pushed from the upper portion thereof toward the surface the metal mold.

Screw insertion holes 24*a*, 24*b* to fasten an assembled reactor main body to a casing 4 are provided in both upper ends of the first covering portion 21. When screws 41*a*, 41*b* fitted in those screw insertion holes 24*a*, 24*b* are fastened with screw holes of the casing 4, the first resin-molded body 20 is fastened to the casing 4. The holders 32*a*, 32*b* provided separately from the resin-molded body 30 are engaged with both upper ends of the second covering portion 31, and those holders 32*a*, 32*b* are provided with screw insertion holes 34*a*, 34*b* to fasten the reactor main body to the casing 4. When the screws 41*a*, 41*b* fitted in those screw insertion holes 34*a*, 34*b* are fastened to the casing 4, the second resin-molded body 30 is fastened to the casing 4.

Support plates 25, 35 to hold a sensor are provided, at locations held between the right and left bobbins 22*a*, 22*b*, inside the first and second covering portions 21, 31. The support plates 25, 35 are each a triangular member that allows a fitting of a sensor 6 between both plates at the time of an assembling of the annular core 1. A lead wire 61 of the sensor 6 is drawn to the side of the second covering portion 31, and a connector 62 is connected to the tip of such a wire.

Right and left coils 51*a*, 51*b* are wound around respective outer circumferences of the right and left bobbins 22*a*, 22*b*. Those right and left coils 51*a*, 51*b* are each formed by, for example, a conductor wire, and both ends of each coil are drawn in the directions of the first and second covering portions 21, 31. The lead portions are connected to bus bars 73*a*, 73*b* of a first terminal stage 71*a*, and a bus bar 73*c* of a second terminal stage 71*c*.

That is, the first terminal stage 71*a* separate from the first covering portion 21 is disposed on the upper portion of the first covering portion 21 in a freely detachable manner. The terminal stages 71*a* has the bus bars 73*a*, 73*b* disposed thereinside by molding, and portions of the bus bars 73*a*, 73*b* are lifted upwardly, and the ends of the coils 51*a*, 51*b* are connected to those lifted portions. The terminal stage 71*a* is formed integrally with two recesses 72*a*, 72*b*, and ends of the bus bars at the wiring side are exposed in those recesses 72*a*, 72*b*. Screw insertion holes 74*a*, 74*b* are provided in those recesses 72*a*, 72*b* and other ends of the bus bars 73*a*, 73*b*, and unillustrated screws fitted in those screw holes 74*a*, 74*b* connect the other ends of the bus bars 73*a*, 73*b* with wirings to an external device.

The second terminal stage 71*c* separate from the second covering portion 31 is disposed on the upper portion of the second covering portion 31 in a freely detachable manner. The bus bar 73*c* to be connected with the respective ends of the right and left coils 51*a*, 51*b* is embedded in the terminal stage 71*c* by molding. The one end of the bas bur 73*c* is divided into two branches. The respective leading ends of those branches protrude from the terminal stage 71*c*, and connected to the respective ends of the coils 51*a*, 51*b*. The other end of the bus bar 73*c* is exposed in a recess 72*c* provided in the terminal stage 71*c*, and a wiring to the external device is fastened by a screw to a screw insertion hole 74*c* provided at the exposed portion.

Screw insertion holes 75*a*, 75*b* are provided in respective lower both ends of the first terminal 71*a* and the second terminal 71*c*, and when screws 43*a*, 43*b* fitted in those screw insertion holes 75*a*, 75*b* are fastened with the casing 4, the first terminal stage 71*a* and the second terminal stage 71*c* are fastened to the casing 4.

The second terminal stage 71*c* is formed integrally with the holder 8 of the connector 62. The shape of the holder 8 is not limited to any particular one as long as the connector 62 can be fixed to the covering portion 31, but according to this embodiment, the following shape is employed in accordance with the shape of the connector 62.

Figure 8:
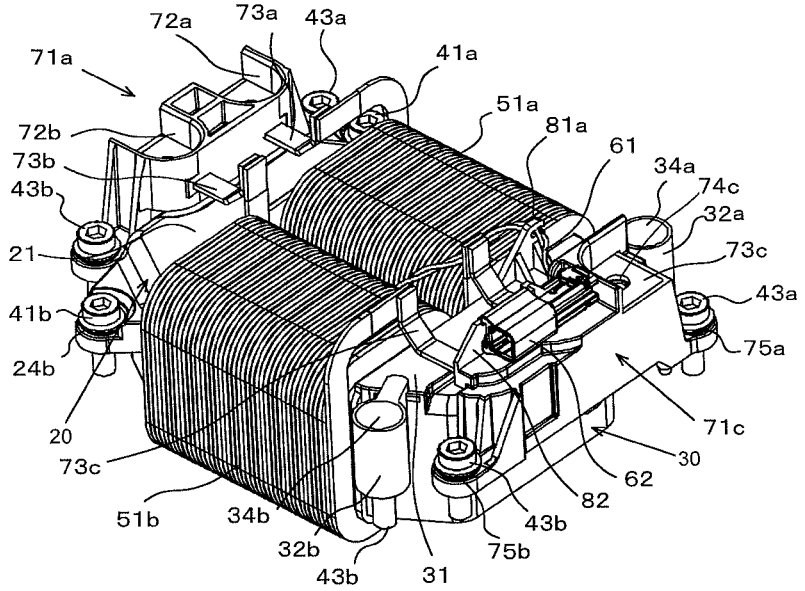
FIG. 8 is a perspective view of the reactor in FIG. 7 as viewed from the front right.
Figure 9:
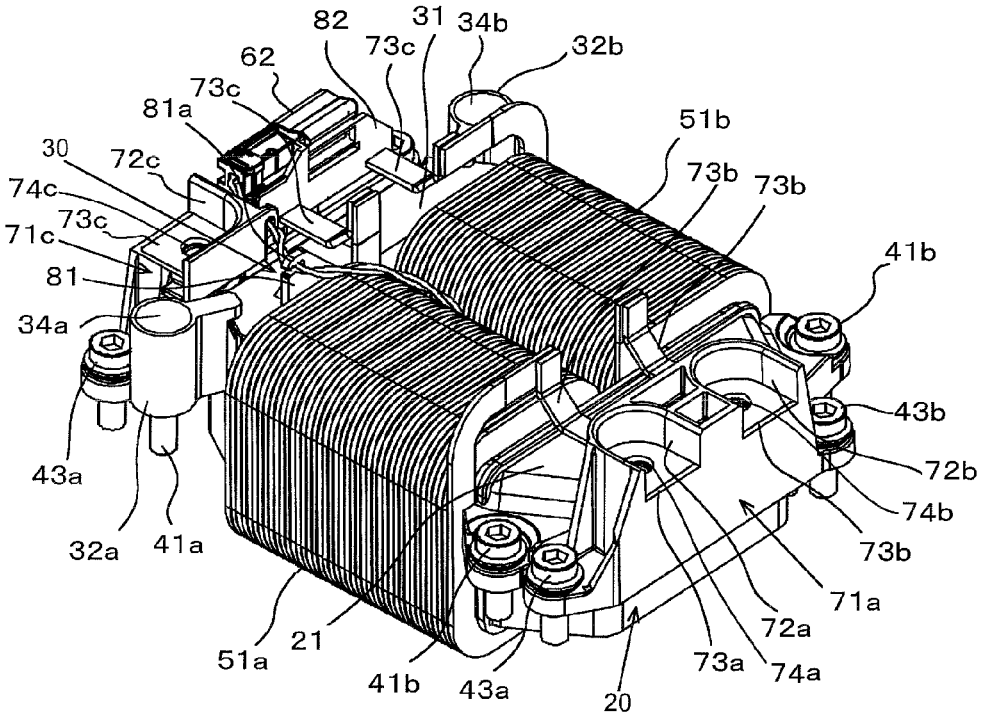
FIG. 9 is a perspective view of the reactor in FIG. 8 as viewed in a mirror-reversed manner.
Figure 10:
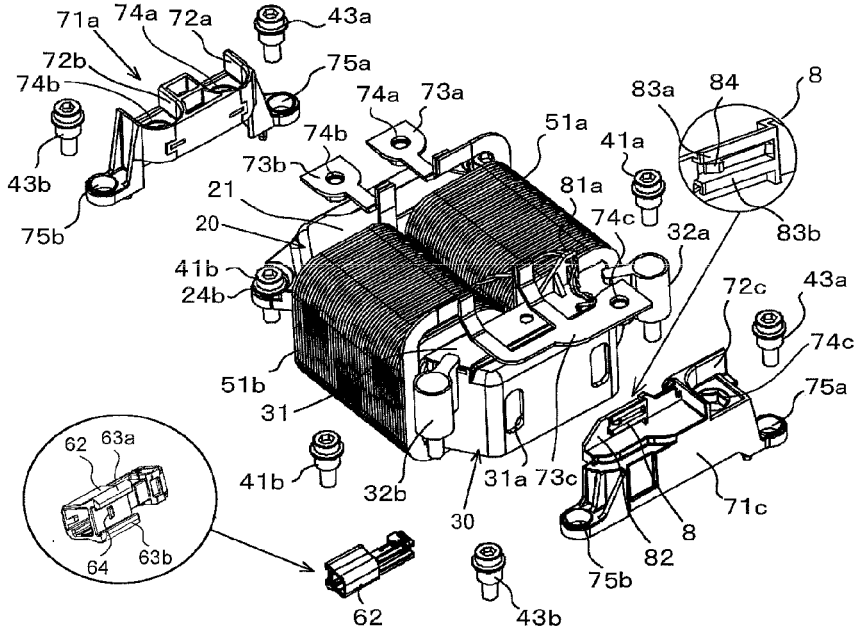
FIG. 10 is a partial exploded perspective view of the reactor in FIG. 7 as viewed from the front right.
Figure 11:
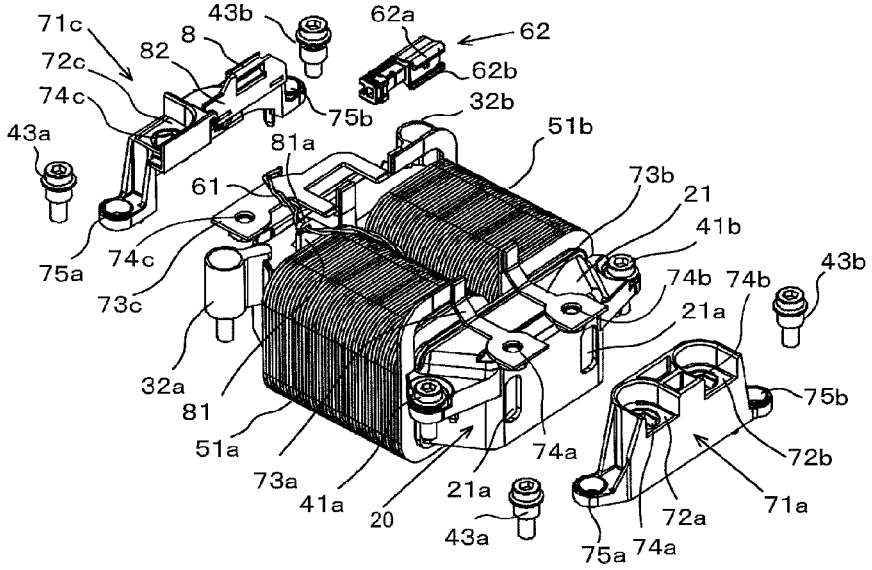
FIG. 11 is a partial exploded perspective view of the reactor in FIG. 10 as viewed in a mirror-reversed manner.

As illustrated in FIGS. 8 and 9, a vertically uprising wall 81 is provided at a portion of the upper face of the covering portion 31 at the bobbin side, and a catch 81*a* to hook up the lead wire of the sensor 6 is provided at the upper edge of the wall 81.

A block 82 in parallel with the wall 81 of the covering portion 31 is formed on the upper face of the second terminal stage 71*c* at the bobbin side, and this block 82 is provided with upper and lower two guides 83*a*, 83*b* running orthogonal to the axial direction of the bobbin while maintaining a predetermined clearance in parallel with each other. The upper and lower two guides 83*a*, 83*b* each have an L-shaped cross section, and the vertical portions thereof are fitted in two slots 63*a*, 63*b* provided in the connector 62 in a freely slidable manner. A hook 84 is provided between the upper and lower two guides 83*a*, 83*b*, and the hook 84 has a basal portion fixed to the block 82 as well as a free end. The end of this hook 84 is engaged with a protrusion 64 provided between the two slots 63*a*, 63*b* of the connector 62.

When the annular core 1, the resin-molded bodies 20, 30, the right and left reactors 51*a*, 51*b*, and the first and second terminal stages 71*a*, 71*c* are assembled together, the reactor main body is formed. The reactor main body is fastened to the casing 4 by fastening the resin-molded bodies 20, 30 by the screws 41*a*, 41*b*, and fastening the terminal stages 71*a*, 71*c* by the screws 43*a*, 43*b* to the casing 4. In this case, as illustrated in the cross-sectional view of FIG. 12, the resin-molded bodies 20, 30 and the right and left coils 51*a*, 51*b* are fastened so as to maintain a predetermined clearance between the outer circumferences thereof and the inner face of the casing 4. When a filler 9 is filled in such a clearance and is cured, the casing 4 and the assembled reactor main body are integrated together.

Advantageous Effects

According to this embodiment employing the above-explained structure, the following advantageous effects can be accomplished.

Figure 12:
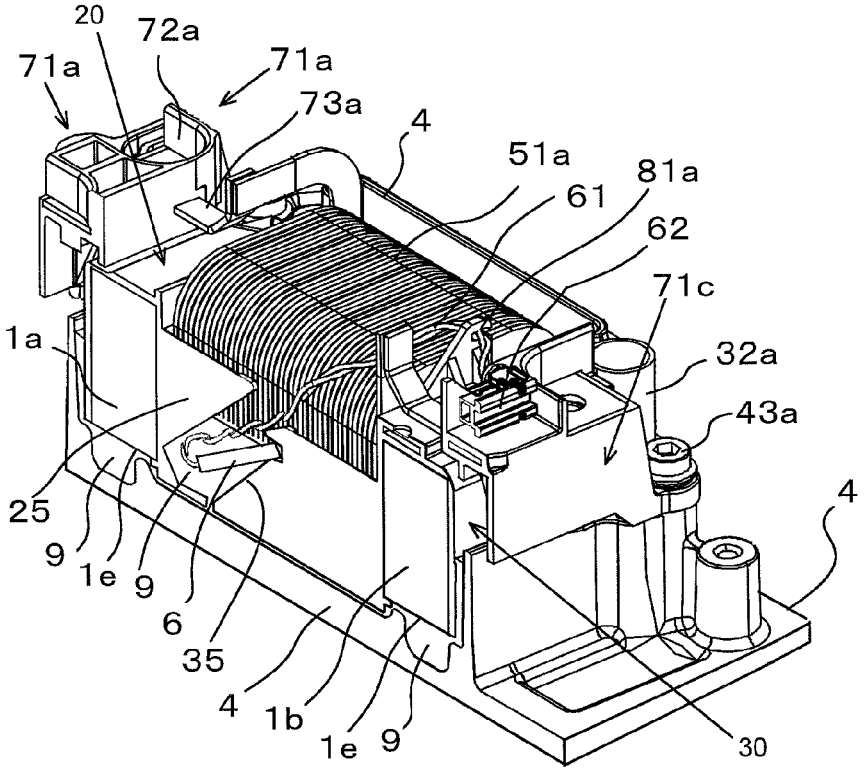
FIG. 12 is a cross-sectional view of the reactor in FIG. 7 as viewed from the front right.
Figure 13:
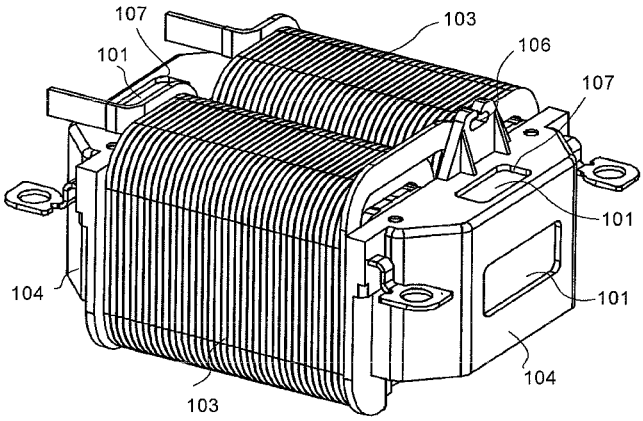
FIG. 13 is a perspective view illustrating an example conventional reactor.
Figure 14:
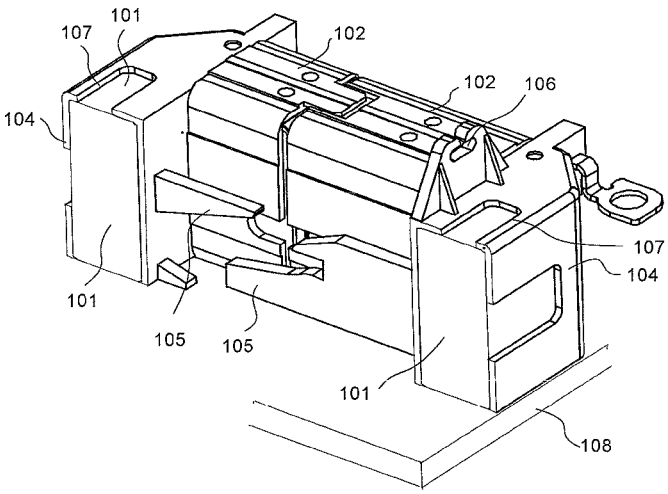
FIG. 14 is a cross-sectional view illustrating the example conventional reactor.

(1) As illustrated in the cross-sectional view of FIG. 12, the bottoms (exposed area 1*e*) of the U-shaped cores 1*a*, 1*b* exposed at the bottoms of the covering portions 21, 31 are covered by the filled filler 9. As a result, even if there is a resin that forms bottom burrs of the U-shaped cores 1*a*, 1*b* at the time of molding, such portions are covered by the filler 9, which does not cause a technical problem. Conversely, it is unnecessary to provide an opening in the upper portion of the covering portion 31, and thus the terminal stage 71*c* including the holder 8 can be provided at this portion to fasten the connector 62. As a result, it becomes possible to retain the connector 62 substantially within a planar projection area of the resin-molded body 30, thus downsizing the reactor.

(2) Since the bus bars 73*a* to 73*c* are embedded in the terminal stages 71*a*, 71*c* which are separate pieces from the resin-molded bodies 20, 30, by molding, it is sufficient if merely the cores 1*a*, 1*b* are embedded in the resin-molded bodies 20, 30, at the time of molding. Accordingly, the number of components retained in the mold when the resin-molded bodies 20, 30 are molded can be reduced, the structure of the mold can be simplified, and an opening for inserting a jig to hold the component can be provided in any arbitral location in the resin-molded bodies 20, 30. As a result, the opening of the resin-molded body does not restrict the locations of the bus bar and the holder, thus increasing the degree of freedom for the structure of the reactor.

(3) Since the resin-molded bodies 20, 30 and the terminal stages 71*a*, 71*c* are separate pieces, the terminal stages 71*a*, 71*c* can be provided at an arbitral locations on the resin-molded bodies 20, 30 and the casing 4. Hence, the drawing directions of the bus bars 73*a* to 73*c* from the coils can be set freely without a modification to the resin-molded bodies 20, 30. In addition, like this embodiment, when the terminal stage 71*c* is provided with the holder 8, if the position of the holder 8 is changed in accordance with the position of the terminal stage 71*c*, the wiring of an electronic component in the reactor can be drawn in an arbitral direction.

(4) According to this embodiment explained above, a connection to the reactor can be easily established, and the connector is laid out in a dead space. In addition, in the case of a reactor having a large number of connections, the connector can be laid out while ensuring a joining work area like welding. Still further, functions like the holding function of the bus bar and the connector are concentrated in the terminal stage 71*c*, and thus the number of components can be reduced, thereby reducing the costs.

3. Other Embodiments

The present disclosure is not limited to the aforementioned embodiments, and covers other embodiments described below.

(1) According to the aforementioned embodiments, since the connector is large relative to the reactor, the connector is disposed in a manner orthogonal to the axial direction of the bobbin. When, however, the connector is relatively small, the holder may be provided which disposes the connector in parallel with the axial direction of the bobbin.

(2) According to the aforementioned embodiments, the whole connector is designed so as to be retained in the planar projection area of the resin-molded body 2 (First Embodiment) or the resin-molded body 30 (Second Embodiment), but it is fine if a part of the connector protrude from the planar projection area of the resin-molded body 2 or 30, or protrude from the periphery of the casing.

(3) Applicable cores are one which is a combination of two U-shaped cores in an annular shape or is a combination of two U-shaped cores and multiple I-shaped cores in an annular shape. As an annular core, an E-shaped core having right and left core legs and a center core leg in parallel therewith may be applied, and a coil may be wound around the center core leg or right and left core legs. The annular core may be formed of a single piece.

(4) According to the first embodiment, the I-shaped core is fitted in the bobbin and is fastened thereto, but like the U-shaped cores, the I-shaped core may be embedded in the resin-molded body 2 by molding.

(5) Various sensors that detect other physical quantities than the temperature sensor are applicable. Example physical quantities are magnetism, electricity, position, vibration, and humidity. It is possible to hold a connector connected to other electronic component than the sensor.

(6) As to the holder shape, a slit, a recess or a through-hole in which the whole connector is fitted is applicable. A hook or a recess may be provided at the connector, and a protrusion or a hook engaged therewith may be formed as the holder. When the connector is fastened by a band, a wire, etc., a hole through which the band, etc., passes may be utilized as the holder. The resin-molded body provided with the terminal stage may be provided with the holder.

(7) As to the casing, a metal casing other than aluminum or a resin casing with an excellent heat transfer characteristic are also applicable. As the the shape of the casing, in addition to the illustrated box shape having a top opened, a dish shape with a shallow edge, or a plate shape is applicable. In addition, an assembly including the annular core, the resin-molded body and the coil only without applying a resin to the casing and the clearance thereof is also an embodiment of the present disclosure.

(8) The connector of the present disclosure is not limited to the illustrated structure. All members that connect the lead wire of the sensor with an external wiring, and that employ a joint structure to be fastened to the reactor by, for example, fitting, sliding, welding, and fastening are subjected to the present disclosure. The present disclosure is applicable to a reactor provided with multiple connectors. Instead of the connector, a transmitter and a device that transmits data on a physical quantity detected by the sensor in a wireless manner can be attached to the holder.

(9) According to the second embodiment, the terminal stages 71*a*, 71*c* and the resin-molded bodies 20, 30 are respectively fastened to the casing 4 by screws, but the terminal stages 71*a*, 71*c* may be fastened to the resin-molded bodies 20, 30. When no terminal stages 71*a*, 71*c* is provided at the two yoke-portion sides of the core and the drawing direction from the coil is one direction, the terminal stage may be provided at only one yoke-portion side. In addition, the number of resin-molded bodies is not limited to two, and the present disclosure is applicable to reactors having the whole annular core formed as a resin-molded body by molding, or having equal to or greater than three resin-molded bodies such that the annular core includes multiple divisional cores. In such cases, all resin-molded bodies may be provided with respective terminal stages, or one of or multiple selected resin-molded bodies may be provided with respective terminal stages.

(10) The position of the terminal stage is not limited to the yoke-portion side of the core, and the terminal stage may be disposed in parallel with the axial direction of the coil at the side of the coil. In this case, the connector holder may be integrally provided with the terminal stage, or may be integrally provided with the resin-molded body 20 or 30.

What is claimed is:

1. A reactor comprising:
an annular core;
a coil wound around an outer circumference of the annular core;
a resin-molded body comprising a covering portion of the annular core and a bobbin around which the coil is wound, the covering portion and the bobbin being formed integrally;
a core exposed area provided in a lower face of the covering portion;
a holder formed integrally with the covering portion at an upper portion thereof;
a connector held by the holder; and
a sensor connected to the connector and detecting a state of the reactor and outputting a signal through the connector.

2. The reactor according to claim 1, further comprising a casing that retains thereinside an assembly comprising the resin-molded body and the coil wound around the bobbin.

3. The reactor according to claim 2, further comprising:
a clearance formed between the assembly and the casing; and
a filler filled and cured in the clearance to cover the core exposed area.

4. The reactor according to claim 1, wherein:
the annular core comprises two U-shaped cores;
the resin-molded body comprises a terminal-side resin-molded body and a bobbin-side resin-molded body in which the U-shaped cores are embedded respectively; and
the bobbin-side resin-molded body comprises a pair of the right and left bobbins, and the holder formed integrally with the pair of right and left bobbins.

5. The reactor according to claim 1, further comprising:
a block formed on an upper face of the covering portion;
a guide provided at the block, extending orthogonal to an axial direction of the bobbin and engaged with the connector; and
a hook fixed to the block at its basal portion and engaged with the connector.

6. The reactor according to claim 1, further comprising a catch portion for a lead wire of the sensor provided on a wall of an upper face of the covering portion.

7. The reactor according to claim 2, further comprising a bracket integrally formed with the resin-molded body and fastening the resin-molded body to the casing.

8. The reactor according to claim 4, further comprising a terminal stage provided near the terminal-side resin-molded body and connected to an end of the coil.

9. A reactor comprising:
an annular core;
a coil wound around an outer circumference of the annular core;
a lead portion provided at an end of the coil;
a bus bar connected to the lead portion;
a resin-molded body comprising a covering portion in which the annular core is embedded;
a terminal stage provided separately from the resin-molded body, and having the bus bar embedded therein by molding;
a first holder integrally formed with the terminal stage;
a connector held by the first holder,
a sensor connected to the connector;
a core exposed area provided in a lower face of the covering portion, and
a second holder formed integrally with the covering portion at an upper portion thereof.

10. The reactor according to claim 9, wherein the terminal stage is provided on an upper face of the resin-molded body.

11. The reactor according to claim 9, wherein no opening is present in an upper face of the resin-molded body.

12. The reactor according to claim 9, further comprising:
a casing that retains thereinside an assembly comprising the resin-molded body and the coil;
a clearance formed between the assembly and the casing; and
a filler filled and cured in the clearance to cover the core exposed area.

13. The reactor according to claim 9, further comprising:
a guide provided at the first holder, extending orthogonal to an axial direction of the coil and attached with the connector; and
a hook provided on the first holder and engaged with the connector which is attached to the guide.

14. A reactor comprising:
an annular core;
a coil wound around an outer circumference of the annular core;
a lead portion provided at an end of the coil;
a bus bar connected to the lead portion;
a resin-molded body comprising a covering portion in which the annular core is embedded;
a plurality of terminal stages which are provided separately from the resin-molded body, and each of which has the bus bar embedded therein by molding;
a first holder integrally formed with the terminal stage;
a connector held by the first holder;

a sensor connected to the connector;

a core exposed area provided in a lower face of the covering portion; and a second holder formed integrally with the covering portion at an upper portion thereof.

15. The reactor according to claim 14, wherein the plurality of terminal stages are provided on an upper face of the resin-molded body.

16. The reactor according to claim 14, wherein no opening is present in an upper face of the resin-molded body.

17. The reactor according to claim 14, further comprising:

a casing that retains thereinside an assembly comprising the resin-molded body and the coil;

a clearance formed between the assembly and the casing; and a filler filled and cured in the clearance to cover the core exposed area.

18. The reactor according to claim 14, further comprising:

a guide provided at the first holder, extending orthogonal to an axial direction of the coil and attached with the connector; and a hook provided on the first holder, and engaged with the connector which is attached to the guide.

* * * * *